US011278460B2

(12) United States Patent
Lyckestig et al.

(10) Patent No.: US 11,278,460 B2
(45) Date of Patent: Mar. 22, 2022

(54) SLING BAR DEVICES FOR PERSON LIFTING SYSTEMS AND METHODS FOR OPERATING SLING BAR DEVICES

(71) Applicant: Liko Research & Development AB, Luleä (SE)

(72) Inventors: Johan Lyckestig, Luleä (SE); Karin L. Olsson, Södra Sunderbyn (SE)

(73) Assignee: Liko Research & Development AB, Lulea (SE)

( * ) Notice: Subject to any disclaimer, the term of this patent is extended or adjusted under 35 U.S.C. 154(b) by 361 days.

(21) Appl. No.: 15/985,905

(22) Filed: May 22, 2018

(65) Prior Publication Data

US 2018/0369044 A1 Dec. 27, 2018

Related U.S. Application Data

(60) Provisional application No. 62/523,319, filed on Jun. 22, 2017.

(51) Int. Cl.

| | |
|---|---|
| ***A61G 7/10*** | (2006.01) |
| ***B66C 23/48*** | (2006.01) |
| ***B66C 1/14*** | (2006.01) |

(52) U.S. Cl.

CPC ..... *A61G 7/1017* (2013.01); *A61G 7/1061* (2013.01); *B66C 23/48* (2013.01); *A61G 7/1042* (2013.01); *A61G 7/1046* (2013.01); *B66C 1/14* (2013.01)

(58) Field of Classification Search

CPC .. A61G 7/1017; A61G 7/1061; A61G 7/1042; A61G 7/1046; B66C 23/48; B66C 1/14

See application file for complete search history.

(56) References Cited

U.S. PATENT DOCUMENTS

| | | | | | |
|---|---|---|---|---|---|
| 2,020,174 | A * | 11/1935 | Derossi | B66C 1/20 | 294/81.55 |
| 3,972,553 | A * | 8/1976 | Johnston | B66C 1/10 | 294/81.3 |
| 4,826,228 | A * | 5/1989 | Dinitz | B66C 1/12 | 294/67.1 |
| 7,802,328 | B2 * | 9/2010 | Lingegard | A61G 7/1019 | 5/424 |
| 9,737,449 | B1 * | 8/2017 | Howell | A61G 7/1051 | |
| 9,757,297 | B2 * | 9/2017 | Arespong | A61G 7/1051 | |
| 2011/0185495 | A1 * | 8/2011 | Robert-Jones | A61G 7/1061 | 5/83.1 |
| 2016/0184158 | A1 * | 6/2016 | Tu | A61G 7/1051 | 5/87.1 |

* cited by examiner

*Primary Examiner* — David R Hare
*Assistant Examiner* — Alexis Felix Lopez
(74) *Attorney, Agent, or Firm* — Dinsmore & Shohl LLP

(57) ABSTRACT

A sling bar device includes a central hub and a plurality of sling bar arms extending outwardly from the central hub. At least one of the plurality of sling bar arms is rotatable about the central hub to move a connection location from one angular position to another angular position relative to the central hub.

18 Claims, 7 Drawing Sheets

SLING BAR DEVICES FOR PERSON LIFTING SYSTEMS AND METHODS FOR OPERATING SLING BAR DEVICES

CROSS-REFERENCE TO RELATED APPLICATIONS

This application claims the benefit of priority to U.S. Provisional Application No. 62/523,319, titled "Sling Bar Devices for Person Lifting Systems and Methods of Operating Sling Bar Devices," filed Jun. 22, 2017, the details of which are incorporated herein by reference in their entirety.

BACKGROUND

Field

The present specification generally relates to sling bar devices and, in particular sling bar devices for person lifting systems, such as mobile lifts and/or overhead lifts, and methods for operating the same.

Technical Background

Person lifting systems, such as mobile lifts and overhead lifts are often used to transport patients for any number of reasons. For example, overhead lifts may operate like a winch and include a lift motor and a lift drum that is driven by the lift motor. A lift strap may be coupled to the lift drum for lifting and lowering a patient when the drum is rotated and the lift strap is either wound up onto the lift drum or paid out from the lift drum. A sling bar device may be connected to an end of the lift strap. The sling bar device may include a load hook that connects to a patient lift sling.

There are several different types of sling bar devices. One example of a sling bar device includes a cross bar that includes load hooks at opposite ends. These sling bar devices, however, are limited in their usage, requiring interchanging of sling bar devices for different circumstances. What is needed is a sling bar device having different configurations for usage in different circumstances.

SUMMARY

According to one embodiment, a sling bar device includes a central hub and a plurality of sling bar arms extending outwardly from the central hub. At least one of the plurality of sling bar arms is rotatable about the central hub to move a connection location from one angular position to another angular position relative to the central hub.

According to another embodiment, a person lifting device includes a lift actuator and a sling bar device operatively connected to the lift actuator. The lift actuator raises and lowers the sling bar device. The sling bar device includes a central hub and a sling bar connector that extends outwardly from the central hub and that is connected to the accessory coupling. A plurality of sling bar arms extends outwardly from the central hub. At least one of the plurality of sling bar arms is rotatable about the central hub to move a connection location from one angular position to another angular position relative to the central hub.

According to another embodiment, a method of adjusting a sling bar device for lifting a person is provided. The method includes rotating a sling bar arm of the sling bar device about a central hub to move a connection location from one angular position to another angular position relative to the central hub. The sling bar device includes a plurality of sling bar arms extending outwardly from the central hub. The sling bar device is connected to a sling.

Additional features of the sling bar devices and methods for operating the sling bar devices described herein will be set forth in the detailed description which follows, and in part will be readily apparent to those skilled in the art from that description or recognized by practicing the embodiments described herein, including the detailed description which follows, the claims, as well as the appended drawings.

It is to be understood that both the foregoing general description and the following detailed description describe various embodiments and are intended to provide an overview or framework for understanding the nature and character of the claimed subject matter. The accompanying drawings are included to provide a further understanding of the various embodiments, and are incorporated into and constitute a part of this specification. The drawings illustrate the various embodiments described herein, and together with the description serve to explain the principles and operations of the claimed subject matter.

DETAILED DESCRIPTION

Figure 1:
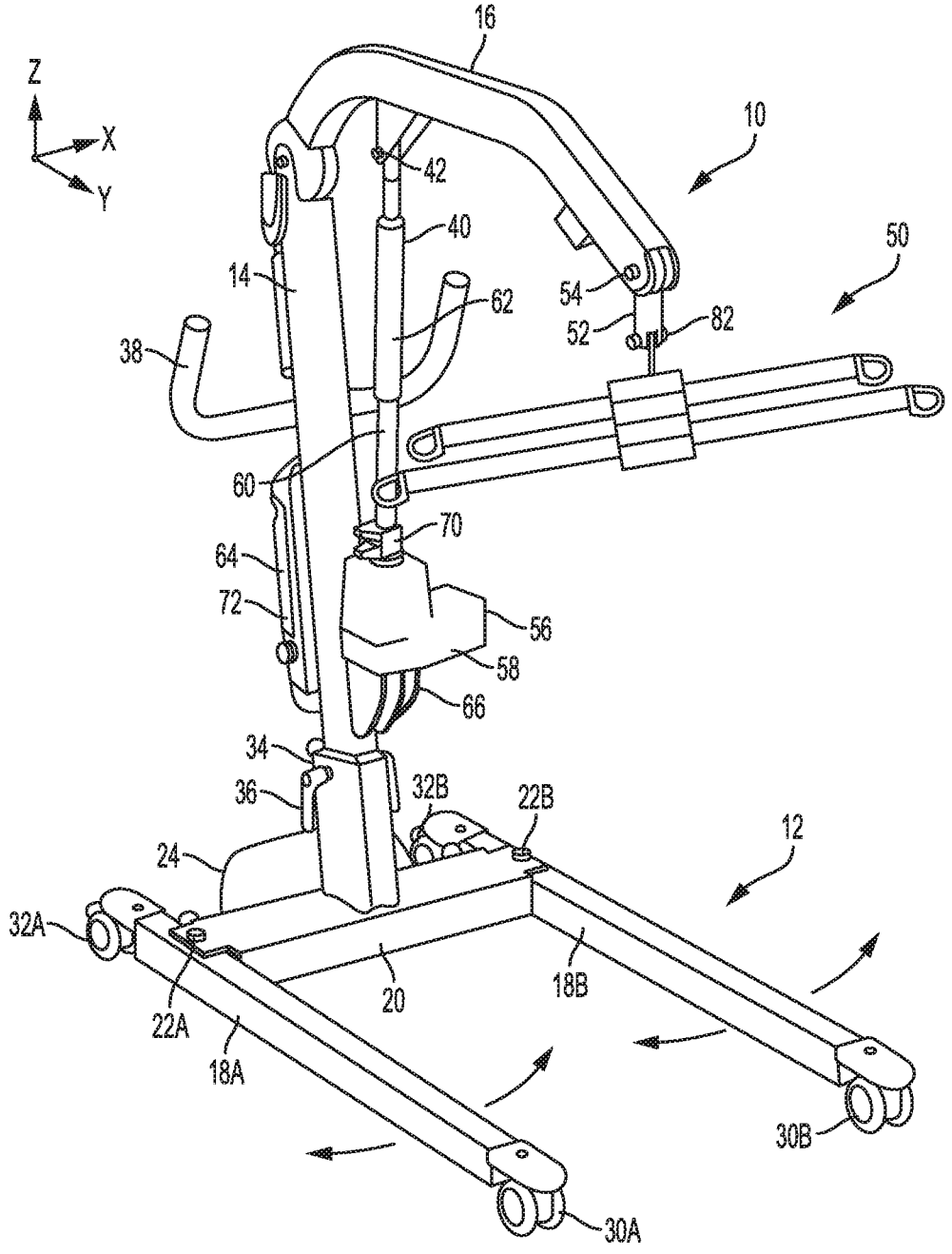
FIG. 1 schematically depicts a front perspective view of a mobile lift according to one or more embodiments shown and described herein.

Reference will now be made in detail to embodiments of sling bar devices for person lifting devices and methods of operating the same, examples of which are illustrated in the accompanying drawings. Whenever possible, the same reference numerals will be used throughout the drawings to refer to the same or like parts. One embodiment of a person lifting device is schematically depicted in FIG. 1, and is designated by the reference numeral 10. The person lifting device may generally include a lift actuator operatively connected to an accessory coupling, whereby the lift actuator raises and lowers the accessory coupling. The accessory coupling connects to a sling bar device, which, in turn, can connect to a patient lift sling. The sling bar device includes multiple lift arms that can be placed in multiple configurations as desired for various circumstances. Various embodiments of sling bar devices for person lifting devices and methods for operating the same will be described herein with specific reference to the appended drawings.

Exemplary Person Lifting Device

Figure 2:
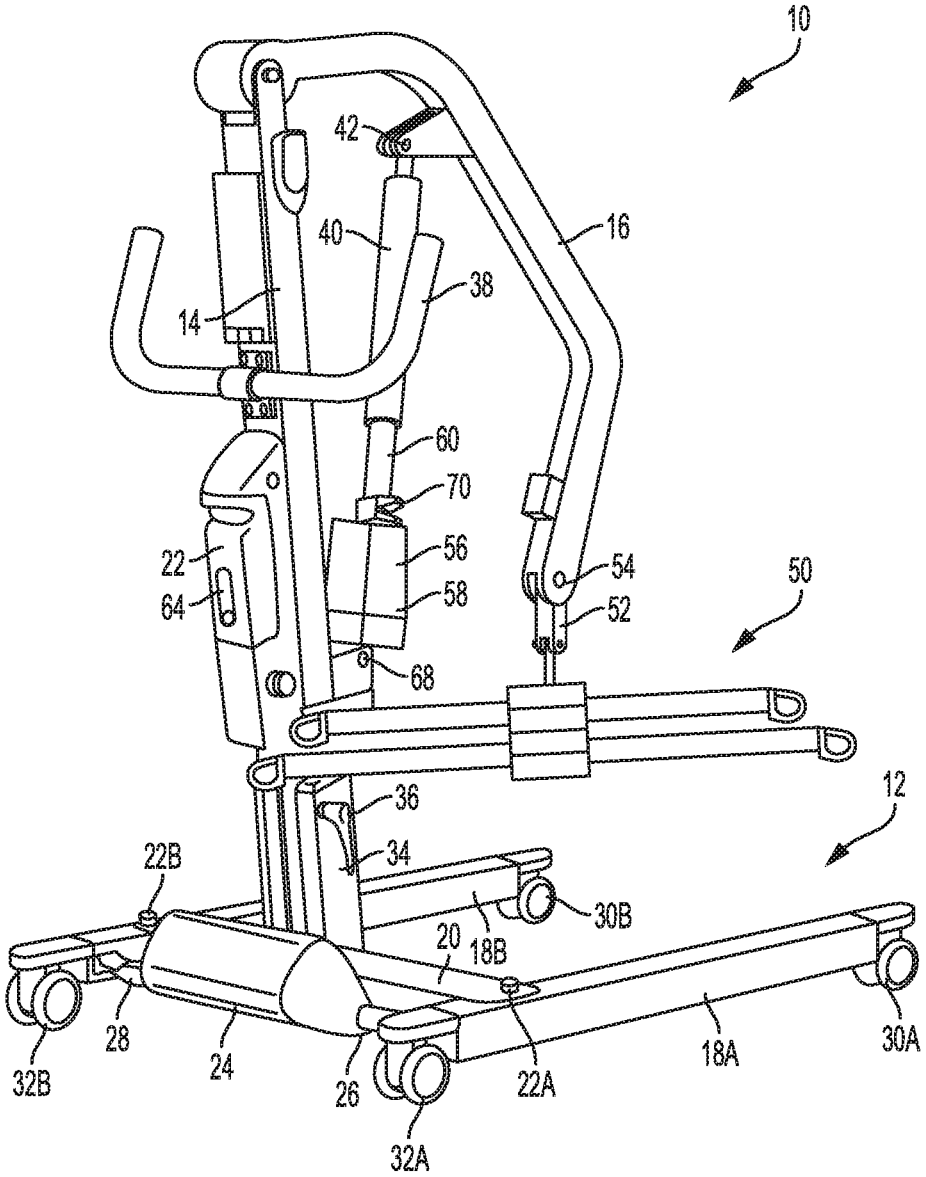
FIG. 2 schematically depicts a rear perspective view of a mobile lift according to one or more embodiments shown and described herein.

Referring to FIGS. 1 and 2, one embodiment of a person lifting device 10 is schematically illustrated. The person lifting device 10 may generally include a base 12, a lift mast 14 and a lift arm 16. The base 12 may include a pair of base legs 18A, 18B which are pivotally attached to a cross support 20 at base leg pivots 22A, 22B such that the base legs 18A, 18B may be pivotally adjusted with respect to the lift mast 14 as indicated by the arrows. The base legs 18A, 18B may be pivoted with a base actuator 24 which is mechanically coupled to both base legs 18A, 18B with base motor linkages 26, 28. In one embodiment, the base actuator 24 may comprise a linear actuator such as a motor mechanically coupled to telescoping threaded rods connected to the base motor linkages 26, 28 such that, when an armature of the motor is rotated, one of the threaded rods is extended or retracted relative to the other. For example, in the configuration shown in FIGS. 1 and 2, when the rods are extended, the base legs 18A and 18B are pivoted towards one another and, when the rods are retracted, the base legs 18A and 18B are pivoted away from one another. The base legs 18A, 18B may additionally include a pair of front castors 30A, 30B and a pair of rear castors 32A, 32B. The rear castors 32A, 32B may include castor brakes.

In one embodiment, the base 12 may further comprise a mast support 34 disposed on the cross support 20. In one embodiment, the mast support 34 may be a rectangular receptacle configured to receive the lift mast 14 of the person lifting device 10. For example, a first end of the lift mast 14 may be adjustably received in the mast support 34 and secured with a pin, threaded fastener, or a similar fastener coupled to adjustment handle 36. The pin or threaded fastener extends through the mast support 34 and into a corresponding adjustment hole(s) on the lift mast 14. Accordingly, the position of the lift mast 14 may be adjusted vertically (e.g., in the +/−Z direction on the coordinate axes shown in FIG. 1) with respect to the base 12 by repositioning the lift mast 14 in the mast support 34. The lift mast 14 may further include at least one handle 38 coupled to the lift mast 14. The at least one handle 38 may provide an operator with a grip for moving the person lifting device 10 on the casters 30, 32. Accordingly, it should be understood that, in at least one embodiment, the person lifting device 10 is mobile.

The person lifting device 10 may further comprise a lift arm 40 which is pivotally coupled to the lift mast 14 at a lift arm pivot 42 at a second end of the lift mast 14 such that the lift arm 40 may be pivoted (e.g., raised and lowered) with respect to the base 12. FIG. 1 shows the lift arm 40 in a fully raised position while FIG. 2 shows the lift arm 40 in a fully lowered position. The lift arm 40 may include a sling bar device 50 that is coupled to the lift arm 40 with an accessory coupling 52 such that the sling bar device 50 is raised or lowered with the lift arm 40. In the embodiment shown in FIGS. 1 and 2 the accessory coupling 52 is pivotally attached to the lift arm 40 at an end of the lift arm 40 opposite the lift arm pivot 42. In one embodiment, the accessory coupling 52 is pivotally attached to the lift arm 40 at attachment pivot 54 such that the sling bar device 50 may be pivoted with respect to the lift arm 40. However, it should be understood that, in other embodiments, the accessory coupling 52 may be fixedly attached to the lift arm 40 or that the sling bar device 50 may be directly coupled to the lift arm 40 without the use of an accessory coupling 52.

The person lifting device 10 may be a mechanized lifting device. Accordingly, raising and lowering the lift arm 40 with respect to the base 12 may be achieved using an actuator such as a lift actuator 56. In the embodiments shown, the lift actuator 56 is a linear actuator which comprises a motor 58 mechanically coupled to an actuator arm 60. More specifically, the motor 58 may include a rotating armature and the actuator arm 60 may include one or more threaded rods coupled to the armature such that, when the armature is rotated, the threaded rods are extended or retracted relative to one another and the actuator arm 60 is extended or retracted. In the embodiment shown in FIG. 1, the lift actuator 56 further includes a support tube 62 disposed over the actuator arm 60. The support tube 62 provides lateral support (e.g., support in the X and/or Y directions) to the actuator arm 60 as the actuator arm 60 is extended. The lift actuator 56 (and base actuator 24) are coupled to an electronic control unit 64 which facilitates actuation and control of both the lift actuator 56 and the base actuator 24.

In the embodiment shown in FIGS. 1 and 2, the lift actuator 56 is fixedly mounted on the lift mast 14 and pivotally coupled to the lift arm 40. In particular, the lift mast 14 includes a bracket 66 to which the motor 58 of the lift actuator 56 is attached while the actuator arm 60 is pivotally coupled to the lift arm 40 at actuator pivot 68. Accordingly, it should be understood that, by actuating the lift actuator 56 with the motor 58, the actuator arm 60 is extended or retracted thereby raising or lowering the lift arm 40 relative to the base 12. In one embodiment, the lift actuator 56 may further comprise an emergency release 70. The emergency release 70 can facilitate the manual retraction of the actuator arm 60 in the event of a mechanical or electrical malfunction of the lift actuator 56.

While the embodiments described herein refer to the lift actuator 56 as including a motor 58 and an actuator arm 60, it will be understood that the actuator may have various other configurations and may include a hydraulic or pneumatic actuator comprising a mechanical pump or compressor, or a similar type of actuator. Further, in other embodiments, where the lifting device is a cable-based lift system, the actuator may be a motor which pays out and/or takes-up cable thereby raising and/or lowering an attached load. Accordingly, it will be understood that various other types of actuators may be used to facilitate raising and lowering the lift arm and/or an attached load with respect to the base 12.

Still referring to FIGS. 1 and 2, the person lifting device 10 may further include the electronic control unit 64. The electronic control unit 64 may include a battery 72 and may be electrically coupled to the lift actuator 56 and the base actuator 24. The electronic control unit 64 may be operable to receive an input from an operator via a control device coupled to the electronic control unit 64. The control device may include a wired controller and/or one or more wireless controllers. For example, in one embodiment, the control device may be a wired controller (such as a pendant or the like) or, alternatively, a controller integrated into the electronic control unit 64. In another embodiment, the controller may be a wireless controller such as a wireless hand control and/or a wireless diagnostic monitor/control. Based on the input received from the control device, the control unit is programmed to adjust the position of the lift arm 40 and/or the position of the base legs 18A, 18B by sending electric control signals to the lift actuator 56 and/or the base actuator 24.

Sling Bar Device

Figure 3:
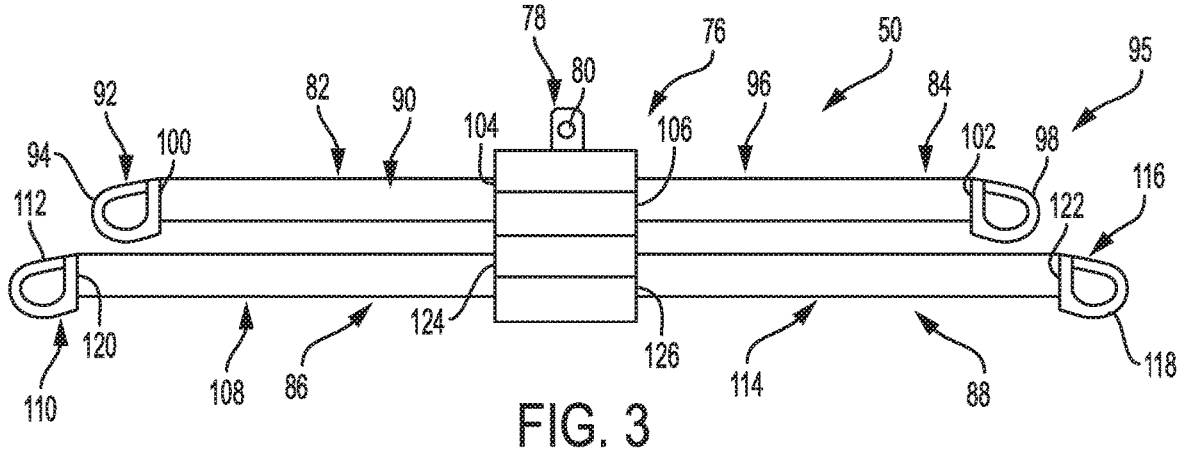
FIG. 3 schematically depicts a sling bar device for use with the mobile lift of FIG. 1 according to one or more embodiments shown and described herein.

Referring to FIG. 3, the sling bar device 50 is illustrated in isolation. The sling bar device 50 includes a central hub 76 including a sling bar connector 78 that is used to connect the sling bar device 50 to the accessory coupling 52 (FIG. 1). For example, the sling bar connector 78 may include an opening 80 extending therethrough that can be connected to the accessory coupling 52 using a connector pin 82 (FIG. 1). Extending outwardly from the central hub 76 are upper sling bar arms 82 and 84 and lower sling bar arms 86 and 88.

Sling bar arm 82 includes an arm portion 90 and a lift hook portion 92 including a lift hook 94 providing a connection location that can be used to connect to, for example, straps of a patient sling or other person support structure. Likewise, sling bar arm 84 includes an arm portion 96 and a lift hook portion 95 including a lift hook 98 providing another connection location that can also be used to connect to a person support structure. The sling bar arm 82 and the sling bar arm 84, in the illustrated example, are aligned axially (i.e., lengthwise) to provide a straight bar structure with the sling bar connector arms 82 and 84 extending from opposite sides of the central hub 76 and connection locations that are axially aligned. As can be seen, in this embodiment, the arm portions 90 and 96 are also vertically straight and do not curve. However, in other embodiments, the arm portions 90 and 96 may have a curve such that ends 100 and 102 of the arm portions 90 and 96 are located below ends 104 and 106 connected to the central hub 76.

Sling bar arm 86 includes an arm portion 108 and a lift hook portion 110 including a lift hook 112 providing a connection location that can be used to connect to a person support structure. Likewise, sling bar arm 88 includes an arm portion 114 and a lift hook portion 116 including a lift hook 118 providing a connection location that can also be used to connect to a person support structure. The sling bar arm 86 and the sling bar arm 88, in the illustrated example, are aligned axially (i.e., lengthwise) to provide a straight bar structure with the sling bar connector arms 86 and 88 extending from opposite sides of the central hub 76 and connection locations that are axially aligned. As can be seen, in this embodiment, the arm portions 108 and 114 are vertically straight and do not curve. However, in other embodiments, the arm portions 108 and 114 may have a curve such that ends 120 and 122 of the arm portions 108 and 114 are located below ends 124 and 126 connected to the central hub 76.

As shown by FIG. 3, arm portions 90 and 96 of sling bar arms 82 and 84 have lengths that are less than lengths of arm portions 108 and 114 of sling bar arms 86 and 88. The sling bar arms 82 and 84 and the sling bar arms 86 and 88 are aligned along respective elongated axes that are parallel to each other. Such a parallel arrangement of the sling bar arms 82, 84, 86 and 88 can provide a twin bar configuration that may be useful with certain person support structures and patient circumstances. Generally, for example, use of narrower sling bar arrangements may be useful to provide a narrower sling configuration where a person may locate arms outside the sling. Use of wider sling bar arrangements may be useful to provide a wider sling configuration where a person may locate arms inside the sling.

Figure 4:
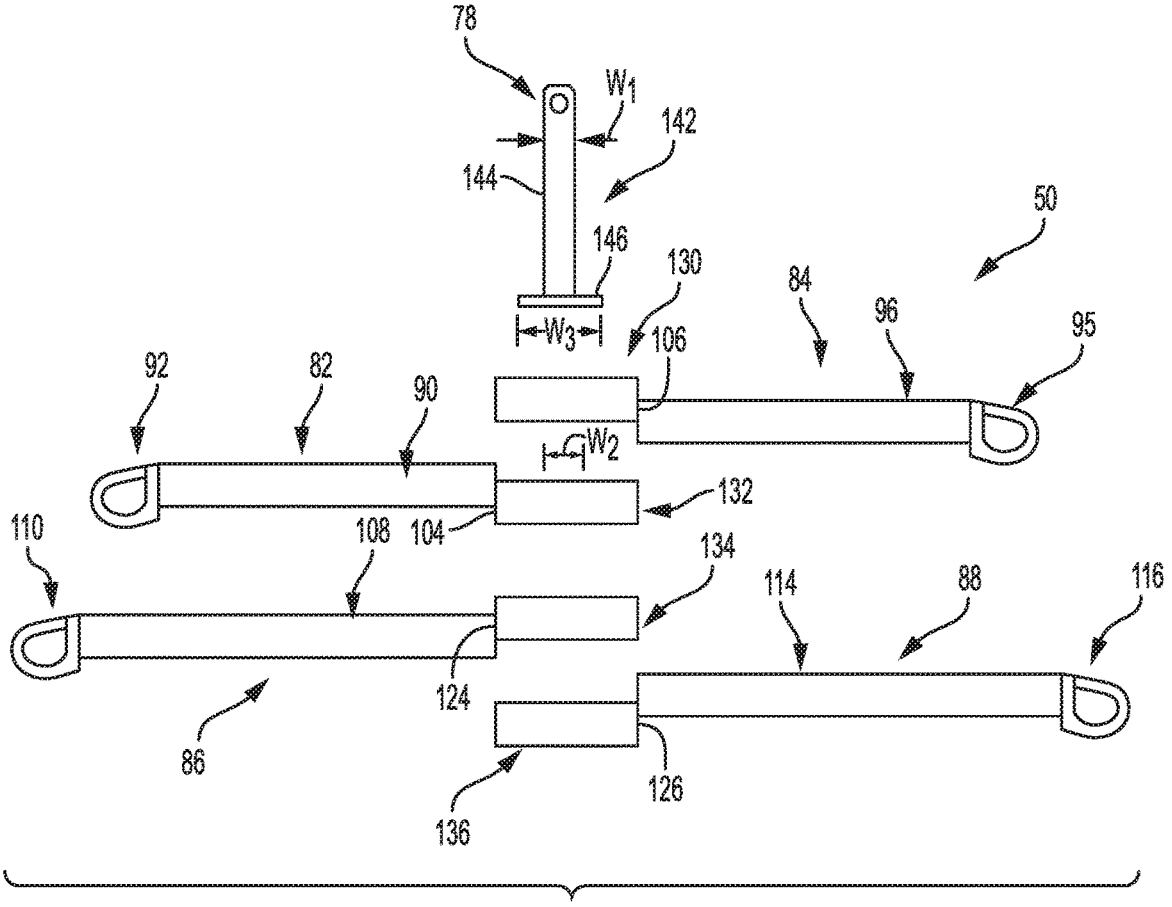
FIG. 4 schematically depicts an exploded view of the sling bar device of FIG. 3 according to one or more embodiment shown and described herein.

Referring to FIG. 4, an exploded view of the sling bar device 50 is illustrated. As can be seen, the sling bar device 50 the includes the sling bar arms 82, 84, 86 and 88 that include the arm portions 90, 96, 108 and 114, respectively, and the lift hook portions 92, 95, 110 and 116. The sling bar arms 82, 84, 86 and 88 also include central hub portions 130, 132, 134 and 136, respectively, that together form the central hub 76 when connected together. In particular, the sling bar arm 82 includes the central hub portion 130 that is connected (e.g., welded, cast, fastened, etc.) at the end 104 of the arm portion 90. In some embodiments, the central hub portion 130 may be offset to a side of the elongated axis of the arm portion 90, which can facilitate stacking of the central hub portions, as will be discussed below. The sling bar arm 84 includes the central hub portion 132 that is connected at the end 106 of the arm portion 96. In some embodiments, the central hub portion 132 may be offset to a side of the elongated axis of the arm portion 96. Likewise, the sling bar arm 86 includes the central hub portion 134 that is connected at the end 124 of the arm portion 108. The central hub portion 134 may be offset to a side of the elongated axis of the arm portion 108. The sling bar arm 88 also includes the central hub portion 136 that is connected at the end 126 of the arm portion 114. In some embodiments, the central hub portion 136 may be offset to a side of the elongated axis of the arm portion 114.

The central hub portions 130, 132, 134 and 136 may be stacked, one on top of another, as shown by FIG. 3. The central hub portions 130, 132, 134 and 136 may be offset from the elongated axis of their respective arm portions 90, 96, 108 and 114 such that each elongated axis passes between adjacent central hub portions 130, 132, 134, 136. In other embodiments, the central hub portions 130, 132, 134 and 136 may not be offset from their respective elongated axis. Providing an offset arrangement for the central hub portions 130, 132, 134 and 136 can provide a reduced height profile for the central hub 76. It should be noted that if an increased height profile is desired, spacers may be utilized between the central hub portions 130, 132, 134 and 136.

Figure 5:
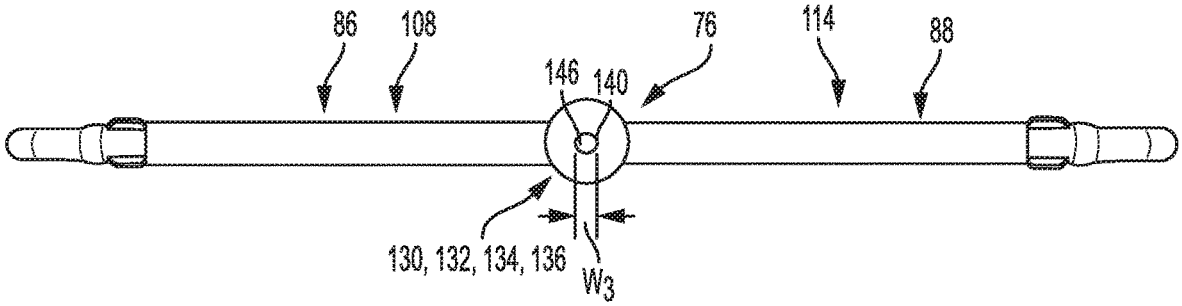
FIG. 5 schematically depicts a bottom view of the sling bar of FIG. 3 according to one or more embodiments shown and described herein.

Referring also to FIG. 5, the central hub portions 130, 132, 134 and 136 may be formed as round (e.g., circular) central hub portions, each having an opening 140 extending therethrough where the openings 140 align to form a continuous opening completely through the central hub 76. As shown by FIG. 4, a hub portion connecting member 142 is used to tie the central hub portions 130, 132, 134 and 136 together and includes an in insert portion 144 and an enlarged portion 146. The insert portion 144 has a width $W_1$ (e.g., outer diameter) that is less than a width $W_2$ of the openings 140 so that the insert portion 144 can be slindingly received by the openings 140. The sling bar connector 78 may extend outwardly beyond the central hub 76 for connecting with the accessory coupling 52 (FIG. 1). Referring again to FIG. 5, the enlarged portion 146 may have a width $W_3$ that is greater than the width $W_2$ of the openings 140 such that the enlarged portion 146 provides a base upon which the central hub portions 130, 132, 134 and 136 can rest with the insert portion 144 passing through the openings 140.

Figure 6:
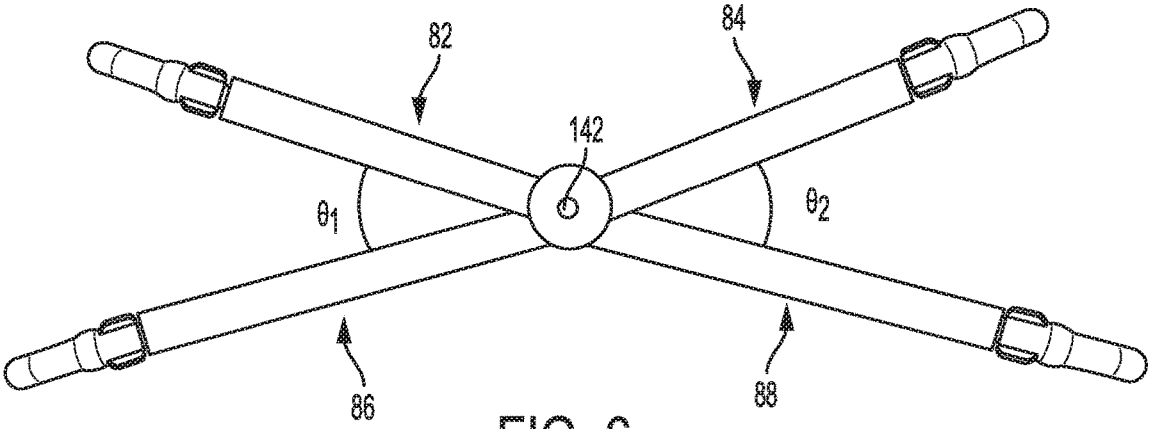
FIG. 6 schematically depicts the sling bar device of FIG. 3 with sling bar arms at different angular positions according to one or more embodiments shown and described herein.

In the example of FIGS. 3 and 5, the upper sling bar arms 82 and 84 are aligned axially with one another and the lower sling bar arms 86 and 88 are aligned axially with one another. This axial alignment of the upper sling bars 82 and 84 and the lower sling bars 86 and 88 is facilitated by the axially offset locations of the central hub portions 130, 132 and 134, 136 to opposite sides of the elongated axes of the arm portions 60, 96 and 108, 114. As can be seen by FIG. 5, the upper sling bar arms 82 and 84 are also aligned vertically with the lower sling bar arms 86 and 88 such that the upper and lower sling bar arms 82, 84 and 86, 88 lie in the same plane forming a twin bar configuration. As can be seen by FIG. 6, the sling bar arms 82, 84, 86 and 88 are rotatable about the hub portion connecting member 142 to provide a variety of configurations.

FIG. 6 illustrates a cross-bar configuration where the sling bar arm 82 is aligned axially with the sling bar arm 88 and the sling bar arm 84 is aligned axially with the sling bar arm 86. In this example, the sling bar arm 82 is rotated about the hub portion connecting member 142 an angle $\theta_1$ relative to the sling bar arm 86 and the sling bar arm 84 is rotated about the hub portion connecting member 142 an angle $\theta_2$ relative to the sling bar arm 88.

It should be noted that the arrangement of the sling bar arms 82, 84, 86 and 88 and their respective connection locations can be used to set a person's sitting posture within a sling. For example, use of two connection locations may provide for a more upright sitting posture. Conversely, use of four connection locations may provide for a more reclined sitting posture.

Figure 7:
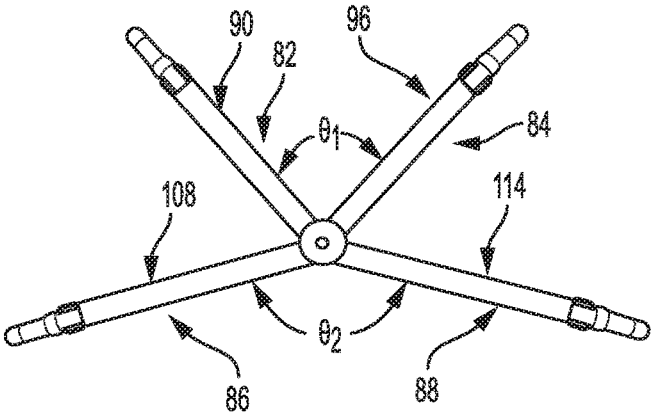
FIG. 7 schematically depicts the sling bar device of FIG. 3 with sling bar arms at different angular positions according to one or more embodiments shown and described herein.

Referring to FIG. 7, another cross-bar configuration is illustrated where the sling bar arms 82, 84, 86 and 88 are not aligned axially. In particular, an angle $\theta_1$ between the sling bar arms 82 and 84 is less than an angle $\theta_2$ between the sling bar arms 86 and 88. This cross-bar configuration can provide four angularly offset connection locations.

The sling bar arms 82, 84, 86, 88 may be formed of a solid metal, such as, for example, steel, titanium, aluminum, alloys or any other metal that is capable of supporting a patient under the desired circumstances. In some embodiments, the sling bar arms 82, 84, 86, 88 are formed of a combination of polymers and metals. The arm portions 90, 96, 108 and 114 may be a single solid beam having a continuous solid cross-section. In other embodiments, the arm portions 90, 96, 108, 114 may be hollow and include a system of trusses therewithin or the arm portions 90, 96, 108, 114 may be fully hollow forming tubes.

Figure 8:
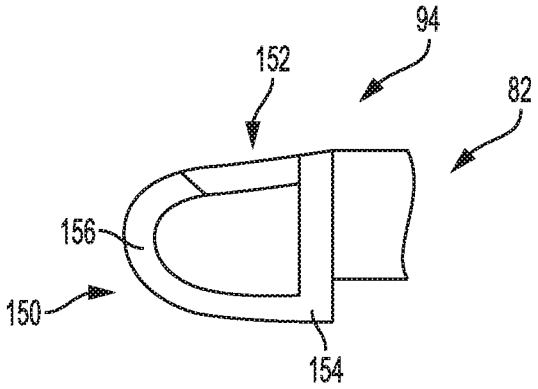
FIG. 8 schematically depicts a lift hoof for use with the sling bar device of FIG. 3 according to one or more embodiments shown and described herein.

Referring to FIG. 8, the lift hooks (lift hook 94 is shown) is located at each end of the sling bar arms 82, 84, 86, 88. The lift hooks 94, 95, 112 and 118 may be rigidly connected to their respective arm portions 90, 96, 108 and 114. The lift hooks 94, 95, 112 and 118 may each include a fixed portion 150 and a moveable portion 152. The fixed portion 150 extends outwardly from ends 154 of the arm portions 90, 96, 108 and 114, transitioning to a bend 156 where the fixed portion 150 extends back toward the end 154. The moveable portions 152 also extend outward from the ends 154 and may be biased toward a closed configuration, engaging the fixed portion 150, as shown by FIG. 8.

Figure 9:
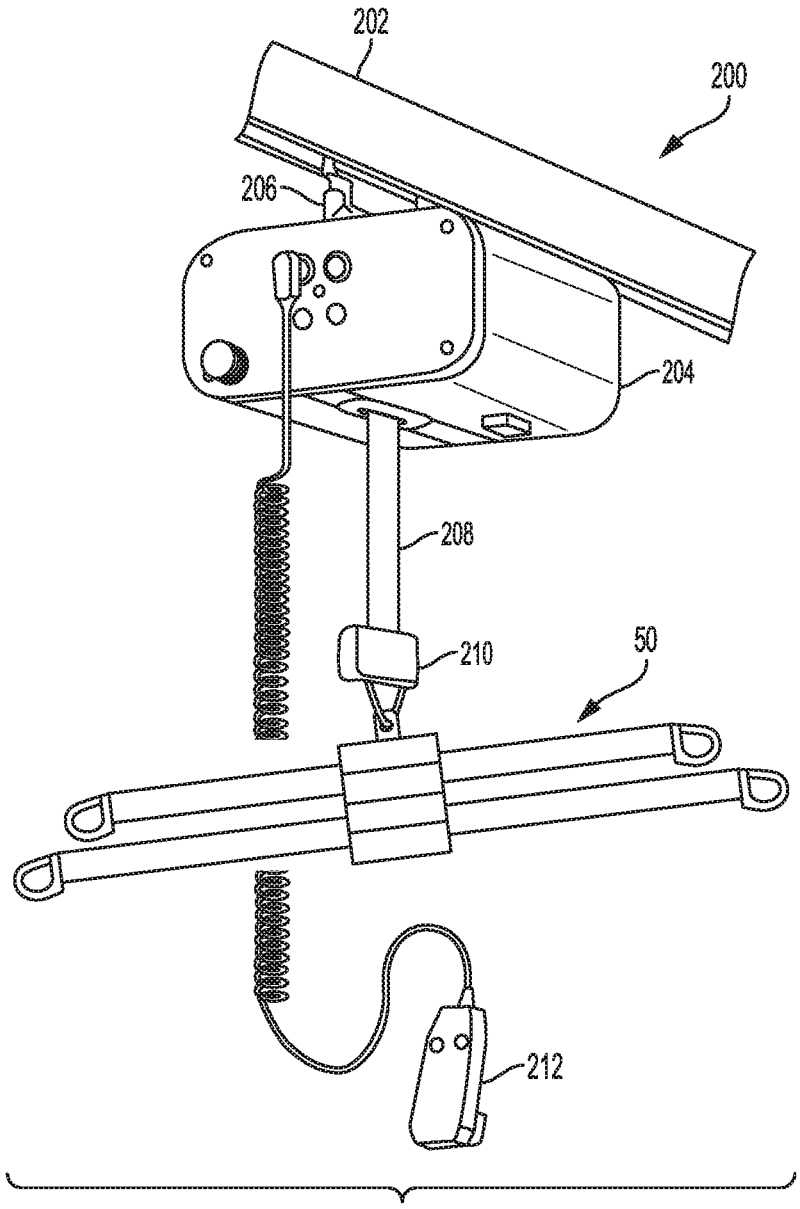
FIG. 9 schematically depicts another person lifting device according to one or more embodiments shown and described herein.

Referring to FIG. 9, another embodiment of a person lifting device 200 is depicted in which the person lifting device 200 is a rail-mounted lift system. In this embodiment, the person lifting device 200 generally comprises a lift unit 204 which is slidably coupled to a rail 202 with a carriage 206. The lift unit 204 may be used to support and/or lift a patient with a lifting strap 208 which is coupled to a lift actuator, in this case a motor, contained within the lift unit 204. The lift actuator facilitates paying-out or taking-up the lifting strap 208 from the lift unit 204 thereby raising and lowering a patient attached to the lifting strap 208. For example, an end of the lifting strap 208 may include an accessory coupling 210 to which the sling bar device 50 may be attached. The lift unit 204 may further include a battery which is housed in the lift unit 204 and electrically coupled to the lift actuator thereby providing power to the lift actuator 233. However, it should be understood that, in other embodiments, the lift unit 204 may be constructed without the battery, such as when the lift actuator is directly wired to a power source. The person lifting device 200 may further include an electronic control unit 212 which is communicatively coupled to the lift actuator and facilitates actuation and control of the lift actuator, specifically paying out and taking up the lifting strap 208.

In the embodiment of the person lifting device shown in FIG. 9, a person may be attached to the lifting strap 208 with sling bar device 50 attached to the lifting strap 208. For example, the sling bar device 50 may be attached to a harness or sling in which the person is positioned to facilitate the lifting operation. The lift unit 204 may be actuated with the electronic control unit 212 to pay out or take up the lifting strap 208 from the lift unit 204. In the embodiment shown in FIG. 9, the electronic control unit 212 is directly wired to the lift unit 204. However, it should be understood that, in other embodiments, the electronic control unit 212 may be wirelessly coupled to the lift unit 204 to facilitate remote actuation of the lift unit 204.

Figure 10:
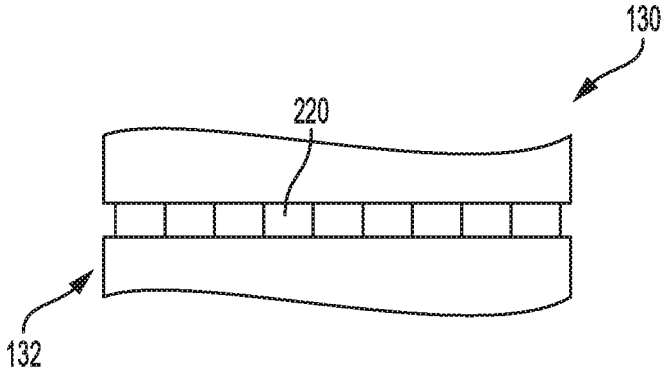
FIG. 10 schematically illustrates a detail view of a central hub for a sling bar device according to one or more embodiments shown and described herein.

The above-described sling bar lifting devices are built up by sling bar arms that can be moved around a central hub to a variety of positions to locate connection locations (e.g., the lift hooks) at desired locations. It should be noted that while four sling bar arms are illustrated, there may be more or less than four sling bar arms. Further, while sling bar arms with lift hooks are illustrated, other modules may be used, such as curved arms or other types of attachment points. In some embodiments, the sling bar arms may be locked into a particular position, for example, using a fastener. Referring briefly to FIG. 10, the central hub portions 130, 132, 134 and 136 may be provided with interlocking teeth 220 that can be used to interlock adjacent central hub portions 130, 132, 134 and 136.

Embodiments can be described with reference to the following numbered clauses, with preferred features laid out in the dependent clauses:

1. A sling bar device includes a central hub and a plurality of sling bar arms extending outwardly from the central hub. At least one of the plurality of sling bar arms is rotatable about the central hub to move a connection location from one angular position to another angular position relative to the central hub.

2. The sling bar device of the preceding clause, wherein the at least one of the plurality of sling bar arms is a first sling bar arm, the first sling bar arm comprising an arm portion and a lift hook portion comprising a lift hook providing the connection location.

3. The sling bar device of the preceding clause, wherein the plurality of sling bar arms further comprises a second sling bar arm extending outwardly from the central hub, the second sling bar arm being rotatable about the central hub to move a connection location of the second sling bar arm from one angular position to another angular position relative to the central hub.

4. The sling bar device of the preceding clause, wherein the second sling bar arm comprises an arm portion and a lift hook portion comprising a lift hook providing the connection location of the second sling bar arm.

5. The sling bar device of clause 3 or 4, wherein the first sling bar arm comprises a first central hub portion and the second sling bar arm comprises a second central hub portion, the first central hub portion and the second central hub portion forming at least part of the central hub.

6. The sling bar device of the preceding clause, wherein the first central hub portion is offset to a side of an elongated axis of the arm portion of the first sling bar arm and the second central hub portion is offset to a side of an elongated axis of the arm portion of the second sling bar arm such that the elongated axis of the arm portion of the first sling bar arm is axially aligned with the elongated axis of the arm portion of the second sling bar arm in a straight bar configuration.

7. The sling bar device of any of clauses 3-6, wherein the plurality of sling bar arms further comprises a third sling bar arm extending outwardly from the central hub, the third sling bar arm being rotatable about the central hub to move a connection location of the third sling bar arm from one angular position to another angular position relative to the central hub.

8. The sling bar device of the preceding clause, wherein the third sling bar arm comprises an arm portion and a lift hook portion comprising a lift hook providing the connection location of the third sling bar arm.

9. The sling bar device of clause 7 or 8, wherein the plurality of sling bar arms further comprises a fourth sling bar arm extending outwardly from the central hub, the fourth sling bar arm being rotatable about the central hub to move a connection location of the fourth sling bar arm from one angular position to another angular position relative to the central hub.

10. The sling bar device of the preceding clause, wherein the fourth sling bar arm comprises an arm portion and a lift hook portion comprising a lift hook providing the connection location of the fourth sling bar arm.

11. The sling bar device of clause 9 or 10, wherein the third sling bar arm comprises a third central hub portion and the fourth sling bar arm comprises a fourth central hub portion, the third central hub portion and the fourth central hub portion forming at least part of the central hub.

12. The sling bar device of the preceding clause, wherein the third central hub portion is offset to a side of an elongated axis of the arm portion of the third sling bar arm and the fourth central hub portion is offset to a side of an elongated axis of the arm portion of the fourth sling bar arm such that the elongated axis of the arm portion of the third sling bar arm is axially aligned with the elongated axis of the arm portion of the fourth sling bar arm in a straight bar configuration.

13. A person lifting device includes a lift actuator and a sling bar device operatively connected to the lift actuator. The lift actuator raises and lowers the sling bar device. The sling bar device includes a central hub and a sling bar connector that extends outwardly from the central hub and that is connected to the accessory coupling. A plurality of sling bar arms extends outwardly from the central hub. At least one of the plurality of sling bar arms is rotatable about the central hub to move a connection location from one angular position to another angular position relative to the central hub.

14. The person lifting device of the preceding clause, wherein the at least one of the plurality of sling bar arms is a first sling bar arm, the first sling bar arm comprising an arm portion and a lift hook portion comprising a lift hook providing the connection location.

15. The person lifting device of the preceding clause, wherein the plurality of sling bar arms further comprises a second sling bar arm extending outwardly from the central hub, the second sling bar arm being rotatable about the central hub to move a connection location of the second sling bar arm from one angular position to another angular position relative to the central hub.

16. The person lifting device of the preceding clause, wherein the second sling bar arm comprises an arm portion and a lift hook portion comprising a lift hook providing the connection location of the second sling bar arm.

17. The person lifting device of clause 15 or 16, wherein the first sling bar arm comprises a first central hub portion and the second sling bar arm comprises a second central hub portion, the first central hub portion and the second central hub portion forming at least part of the central hub.

18. The person lifting device of the preceding clause, wherein the first central hub portion is offset to a side of an elongated axis of the arm portion of the first sling bar arm and the second central hub portion is offset to a side of an elongated axis of the arm portion of the second sling bar arm such that the elongated axis of the arm portion of the first sling bar arm is axially aligned with the elongated axis of the arm portion of the second sling bar arm in a straight bar configuration.

19. The person lifting device of any of clauses 15-18, wherein the plurality of sling bar arms further comprises a third sling bar arm extending outwardly from the central hub, the third sling bar arm being rotatable about the central hub to move a connection location of the third sling bar arm from one angular position to another angular position relative to the central hub.

20. The person lifting device of the preceding clause, wherein the third sling bar arm comprises an arm portion and a lift hook portion comprising a lift hook providing the connection location of the third sling bar arm.

21. The person lifting device of clause 19 or 20, wherein the plurality of sling bar arms further comprises a fourth sling bar arm extending outwardly from the central hub, the fourth sling bar arm being rotatable about the central hub to move a connection location of the fourth sling bar arm from one angular position to another angular position relative to the central hub.

22. The person lifting device of the preceding clause, wherein the fourth sling bar arm comprises an arm portion and a lift hook portion comprising a lift hook providing the connection location of the fourth sling bar arm.

23. The person lifting device of clause 21 or 22, wherein the third sling bar arm comprises a third central hub portion and the fourth sling bar arm comprises a fourth central hub portion, the third central hub portion and the fourth central hub portion forming at least part of the central hub.

24. The person lifting device of the preceding clause, wherein the third central hub portion is offset to a side of an elongated axis of the arm portion of the third sling bar arm and the fourth central hub portion is offset to a side of an elongated axis of the arm portion of the fourth sling bar arm such that the elongated axis of the arm portion of the third sling bar arm is axially aligned with the elongated axis of the arm portion of the fourth sling bar arm in a straight bar configuration.

25. A method of adjusting a sling bar device for lifting a person is provided. The method includes rotating a sling bar arm of the sling bar device about a central hub to move a connection location from one angular position to another angular position relative to the central hub. The sling bar device includes a plurality of sling bar arms extending outwardly from the central hub. The sling bar device is connected to a sling.

26. The method of the preceding clause comprising lifting the sling bar device using a person lifting device.

27. The method of clause 25 or 26, wherein the person lifting device is an overhead lifting device or a mobile lifting device.

28. The method of any of clauses 25-27, wherein the at least one of the plurality of sling bar arms is a first sling bar arm, the first sling bar arm comprising an arm portion and a lift hook portion comprising a lift hook providing the connection location, the plurality of sling bar arms further comprising a second sling bar arm extending outwardly from the central hub, the method comprising rotating the second sling bar arm about the central hub to move a connection location of the second sling bar arm from one angular position to another angular position relative to the central hub.

Based on the foregoing, it should be understood that the sling bar devices described herein include a plurality of sling bar arms that are rotatable about a central hub to multiple positions. Moving the sling bar arms from one position to another position relocated connecting locations where a sling can be attached to the sling bar devices. The sling bar arms can be releasably locked in a desired position so that the sling bar arms no longer rotate about the central hub.

It will be apparent to those skilled in the art that various modifications and variations can be made to the embodiments described herein without departing from the spirit and scope of the claimed subject matter. Thus it is intended that the specification cover the modifications and variations of the various embodiments described herein provided such modification and variations come within the scope of the appended claims and their equivalents.

What is claimed is:

1. A sling bar device comprising:

a central hub; and first and second sling bar arms that extend outwardly from the central hub, wherein the first and second sling bar arms are rotatable about the central hub to move a connection location from one angular position to another angular position relative to the central hub;

wherein the first and second sling bar arms each include a central hub portion that rotates about a same central axis of the central hub as the first and second sling bar arms rotate between angular positions;

wherein the first and second sling bar arms each comprise an arm portion that defines an elongated axis, the central hub portion of the first sling bar arm is offset along the same central axis to a side of the elongated axis of the arm portion of the first sling bar arm.

2. The sling bar device of claim 1, wherein the first sling bar arm comprises the arm portion and a lift hook portion comprising a lift hook providing the connection location.

3. The sling bar device of claim 2, wherein the second sling bar arm comprises the arm portion and a lift hook portion comprising a lift hook providing another connection location of the second sling bar arm.

4. The sling bar device of claim 3, wherein the central hub portions form at least part of the central hub.

5. The sling bar device of claim 4, wherein the central hub portion of the second sling bar arm is offset along the same central axis to a side of the elongated axis of the arm portion of the second sling bar arm such that the elongated axis of the arm portion of the first sling bar arm is axially aligned along the same central axis with the elongated axis of the arm portion of the second sling bar arm in a straight bar configuration.

6. The sling bar device of claim 3 further comprising a third sling bar arm extending outwardly from the central hub, the third sling bar arm being rotatable about the central hub to move another connection location of the third sling bar arm from one angular position to another angular position relative to the central hub.

7. The sling bar device of claim 6, wherein the third sling bar arm comprises an arm portion and a lift hook portion comprising a lift hook providing the another connection location of the third sling bar arm.

8. The sling bar device of claim 7 further comprising a fourth sling bar arm extending outwardly from the central hub, the fourth sling bar arm being rotatable about the central hub to move another connection location of the fourth sling bar arm from one angular position to another angular position relative to the central hub.

9. The sling bar device of claim 8, wherein the fourth sling bar arm comprises an arm portion and a lift hook portion comprising a lift hook providing the another connection location of the fourth sling bar arm.

10. The sling bar device of claim 9, wherein the third sling bar arm comprises a central hub portion and the fourth sling bar arm comprises a central hub portion, the central hub portion of the third sling bar arm and the central hub portion of the fourth sling bar arm forming at least part of the central hub.

11. The sling bar device of claim 10, wherein the central hub portion of the third sling bar arm is offset along the same central axis to a side of an elongated axis of the arm portion of the third sling bar arm and the central hub portion of the fourth sling bar arm is offset along the same central axis to a side of an elongated axis of the arm portion of the fourth sling bar arm such that the elongated axis of the arm portion of the third sling bar arm is axially aligned with the elongated axis of the arm portion of the fourth sling bar arm in a straight bar configuration.

12. A person lifting device comprising:

a lift actuator; and a sling bar device operatively connected to the lift actuator using a connector having a connecting location, whereby the lift actuator raises and lowers the sling bar device, the sling bar device comprising:

a central hub;

a sling bar connector extending outwardly from the central hub that is connected to an accessory coupling; and first and second sling bar arms that extend outwardly from the central hub, wherein the first and second sling bar arms are rotatable about the central hub to move a connection location from one angular position to another angular position relative to the central hub;

wherein the first and second sling bar arms each include a central hub portion that rotates about a same central axis of the central hub as the first and second sling bar arms rotate between angular positions, the connecting location located along the same central axis;

wherein the first and second sling bar arms each comprise an arm portion that defines an elongated axis, the central hub portion of the first sling bar arm being offset along the same central axis to a side of the elongated axis of the arm portion of the first sling bar arm.

13. The person lifting device of claim 12, wherein the first sling bar arm comprises the arm portion and a lift hook portion comprising a lift hook providing the connection location.

14. The person lifting device of claim 13, wherein the second sling bar arm comprises the arm portion and a lift hook portion comprising a lift hook providing the another connection location of the second sling bar arm.

15. The person lifting device of claim 14, wherein the second sling bar arm comprises a second central hub portion, the central hub portions form at least part of the central hub.

16. The person lifting device of claim 15, wherein the central hub portion of the second sling bar arm is offset along the same central axis to a side of the elongated axis of the arm portion of the second sling bar arm such that the elongated axis of the arm portion of the first sling bar arm is axially aligned along the same central axis with the elongated axis of the arm portion of the second sling bar arm in a straight bar configuration.

17. A method of adjusting a sling bar device for lifting a person, the method comprising:

rotating a first sling bar arm of the sling bar device about a central hub to move a connection location of the first sling bar arm from one angular position to another angular position relative to the central hub, the sling bar device comprising a plurality of sling bar arms extending outwardly from the central hub; and rotating a second sling bar arm of the sling bar device about the central hub to move another connection location of the second sling bar arm from one angular position to another angular position relative to the central hub;

connecting the sling bar device to a sling;

wherein the first sling bar arm includes a first central hub portion that rotates about a central axis of the central hub as the first sling bar arm is rotating;

wherein the second sling bar arm includes a second central hub portion that rotates about the same central axis of the central hub as the second sling bar arm is rotating;

wherein the first and second sling bar arms each comprise an arm portion that defines an elongated axis, the first central hub portion of the first sling bar arm being offset along the same central axis to a side of the elongated axis of the arm portion of the first sling bar arm.

18. The method of claim 17 further comprising stacking the first central hub portion and the second central hub portion thereby forming the central hub having the central axis.

* * * * *